US012276038B2

(12) United States Patent
Shao et al.

(10) Patent No.: US 12,276,038 B2
(45) Date of Patent: Apr. 15, 2025

(54) PROCESS METHOD FOR CONTROLLING GLOSSINESS OF ELECTROPLATED NICKEL-LAYER

(71) Applicant: Luxshare Precision Industry(Chuzhou), Ltd., Chuzhou (CN)

(72) Inventors: Weihua Shao, Chuzhou (CN); Jiangping Yang, Chuzhou (CN); Dewei Jiang, Chuzhou (CN)

(73) Assignee: Luxshare Precision Industry(Chuzhou), Ltd., Chuzhou (CN)

( * ) Notice: Subject to any disclaimer, the term of this patent is extended or adjusted under 35 U.S.C. 154(b) by 0 days.

(21) Appl. No.: 18/202,157

(22) Filed: May 25, 2023

(65) Prior Publication Data

US 2024/0263334 A1 Aug. 8, 2024

(30) Foreign Application Priority Data

Feb. 3, 2023 (CN) ..... 202310120401.X

(51) Int. Cl.

| | |
|---|---|
| ***C25D 3/12*** | (2006.01) |
| ***C23C 28/02*** | (2006.01) |
| ***C25D 3/38*** | (2006.01) |
| ***C25D 5/00*** | (2006.01) |
| ***C25D 5/14*** | (2006.01) |
| ***C25D 5/34*** | (2006.01) |
| ***C25D 5/50*** | (2006.01) |

(52) U.S. Cl.

CPC ..... *C25D 5/627* (2020.08); *C25D 3/12* (2013.01); *C25D 3/38* (2013.01); *C25D 5/14* (2013.01); *C25D 5/34* (2013.01); *C25D 5/50* (2013.01)

(58) Field of Classification Search

CPC ... C25D 3/12; C25D 3/38; C25D 5/50; C25D 5/627; C25D 5/14; C25D 5/54; C25D 5/34; C23C 28/02

USPC ..... 205/181, 224, 184, 210

See application file for complete search history.

(56) References Cited

U.S. PATENT DOCUMENTS

| | | | | |
|---|---|---|---|---|
| 2009/0038951 | A1* | 2/2009 | Hayashi | C25D 3/38 205/291 |
| 2012/0001307 | A1* | 1/2012 | Cho | H01L 23/49582 427/97.1 |
| 2016/0265131 | A1* | 9/2016 | Hao | C25D 5/627 |
| 2018/0305837 | A1* | 10/2018 | Xiong | C23F 1/20 |
| 2019/0032235 | A1* | 1/2019 | Hashimoto | C23C 18/30 |

FOREIGN PATENT DOCUMENTS

| | | | | | |
|---|---|---|---|---|---|
| CN | 101053095 | A | | 10/2007 | |
| CN | 108166032 | A | | 6/2018 | |
| CN | 112680754 | A | * | 4/2021 | B32B 15/01 |
| CN | 113207237 | A | * | 8/2021 | C25D 5/06 |
| CN | 112981458 | B | | 5/2022 | |
| EP | 3067443 | A1 | * | 9/2016 | B32B 15/01 |
| JP | 2007177263 | A | * | 7/2007 | C25D 3/12 |
| TW | I431170 | B | | 3/2014 | |
| WO | WO-2018073011 | A1 | * | 4/2018 | C25D 3/38 |
| WO | WO-2019215287 | A1 | * | 11/2019 | C25D 5/06 |
| WO | WO-2022123008 | A2 | * | 6/2022 | C25D 15/00 |

OTHER PUBLICATIONS

Moebius et al., "New Nickel- and Hexavalent Chromium Free Matte Coating for Decorative Applications," SUF/FIN Proceedings (2007), pp. 307-310. (Year: 2007).*

Taiwanese Office Action and Search Report for Taiwanese Application No. 112119268, dated May 27, 2024, with an English translation.

* cited by examiner

*Primary Examiner* — Edna Wong

(74) *Attorney, Agent, or Firm* — Birch, Stewart, Kolasch & Birch, LLP

(57) ABSTRACT

Disclosed is a process method for controlling a glossiness of an electroplated nickel-layer, which comprises: subjecting a metal substrate to pre-treatment, copper plating process, satin-nickel plating process, semi-bright-nickel plating process, and post-treatment in turn. The present application can effectively control the surface glossiness of a nickel-layer by optimizing the process flow of the electroplated nickel-layer and process parameters in the electroplating process, so that the glossiness of the product reaches 290-310 Gu, which fully meets the specification requirements of the product glossiness of 280-350 Gu.

12 Claims, No Drawings

PROCESS METHOD FOR CONTROLLING GLOSSINESS OF ELECTROPLATED NICKEL-LAYER

The present application claims the priority of Chinese invention patent application No. 202310120401.X (Application Date: Feb. 3, 2023; Invention Title: process method for controlling glossiness of electroplated nickel-layer), which is incorporated herein in its entirety by reference.

TECHNICAL FIELD

The present application belongs to the technical field of physical chemistry, and relates to a process method for nickel electrolysis, and specifically relates to a process method for controlling a glossiness of an electroplated nickel-layer.

BACKGROUND

Generally speaking, the method of plating a layer of nickel on metals or some non-metals by electrolysis or a chemical method is called nickel plating. Nickel plating is divided into the surface treated nickel and the electroless nickel plating. The surface treated nickel is that in the electrolyte composed of a nickel salt (called main salt), a conductive salt, a pH buffer agent and a wetting agent, an anode is made of metal nickel, a cathode is a plated part, and a uniform and compact nickel plating layer is deposited on the cathode (plated part) through direct current. It is different for the glossiness of the metal nickel layer obtained by different process conditions.

For different application fields, the requirements for the glossiness of the metal nickel layer are also different. For applications with code-printing needs, a high glossiness will affect the code-printing effect.

However, the traditional nickel plating process mainly includes that degreasing, activating treatment, semi-bright-nickel plating process, washing-water and drying capture are performed in turn. The obtained nickel-layer has a black and bright appearance, and the glossiness is about 600 Gu, which is much higher than the glossiness required in the code-printing application field (280-350 Gu).

In summary, it is one of urgent problems to be solved to provide a process method that can control the glossiness of a nickel-layer to meet the process requirements.

SUMMARY

In view of the deficiencies of the prior art, an object of the present application is to provide a process method for controlling a glossiness of an electroplated nickel-layer. The process method can effectively control the glossiness of an electroplated nickel-layer by optimizing the process flow of the electroplated nickel-layer and process parameters in the electroplating process, so that the glossiness of the product reaches 290-310 Gu, which fully meets the specification requirements of the product glossiness of 280-350 Gu.

To achieve the above object, the present application adopts the technical solutions below.

The present application provides a process method for controlling a glossiness of an electroplated nickel-layer, including: subjecting a metal substrate to pre-treatment, copper plating process, satin-nickel plating process, semi-bright-nickel plating process and post-treatment in turn.

The present application can effectively control the glossiness of a nickel-layer surface by subjecting a metal substrate to copper plating process, satin-nickel plating process and semi-bright-nickel plating in turn, so that the glossiness of the product reaches 290-310 Gu, which fully meets the specification requirements of the product glossiness of 280-350 Gu.

An object of the copper plating process in the present application is to protect a metal substrate; an object of the satin-nickel plating process is to improve the corrosion resistance and conductivity of a metal substrate, so that the glossiness of its appearance meets requirements.

As a preferred technical solution of the present application, the metal substrate in the present application may be any metal workpiece.

Preferably, the pre-treatment includes performing degreasing treatment and activating treatment in sequence.

The present application does not limit a method of the degreasing treatment and the activating treatment, as long as the treatment process of the pre-treated metal substrate can be completed (for example, the increase of chemical polishing stations can solve burrs on the surface of the substrate and improve the flatness of the surface of the substrate). Preferably, a plating layer in the copper plating process has a thickness of 1-3 μm, for example, it may be 1 μm, 1.5 μm, 2 μm, 2.5 μm or 3 μm; however, the thickness is not limited to the listed values, and other unlisted values in the numerical range are also applicable.

The thickness of a plating layer in the copper plating process of the present application is 1-3 μm. If the thickness of a plating layer is too thick, the plating time will be prolonged and the cost will be increased; if the thickness of a plating layer is too thin, it is not facilitate to protect the metal substrate and pass the salt spray test.

Preferably, a plating layer in the copper plating process has a roughness Ra of 0.1-0.3, for example, it may be 0.1, 0.14, 0.18, 0.22, 0.26 or 0.3; however, the roughness is not limited to the listed values, and other unlisted values in the numerical range are also applicable.

The present application controls the roughness of the copper plating layer for controlling the density and the glossiness of the crystallization of the subsequent nickel plating layer.

Preferably, the copper plating process has a residence time of 1750-1850 s, for example, it may be 1750 s, 1770 s, 1790 s, 1810 s, 1830 s or 1850 s; however, the residence time is not limited to the listed values, and other unlisted values in the numerical range are also applicable; preferably, 1795-1805 s.

Preferably, the copper plating process has a current density of 0.7-1.0 A/dm$^2$, for example, it may be 0.7 A/dm$^2$, 0.8 A/dm$^2$, 0.9 A/dm$^2$ or 1.0 A/dm$^2$; however, the current density is not limited to the listed values, and other unlisted values in the numerical range are also applicable.

Preferably, a copper plating electrolyte used in the copper plating process includes the following content of raw materials: 13-17 g/L of metal copper, 1.3-1.7 mL/L of a brightener, 9-11 mL/L of a carry, and a remainder is deionized water.

Exemplarily, a content of the metal copper is 13-17 g/L, for example, it may be 13 g/L, 14 g/L, 15 g/L, 16 g/L or 17 g/L, but the content is not limited to the listed values, and other unlisted values in the numerical range are also applicable; a content of the brightener is 1.3-1.7 mL/L, for example, it may be 1.3 mL/L, 1.4 mL/L, 1.5 mL/L, 1.6 mL/L or 1.7 mL/L, but the content is not limited to the listed values, and other unlisted values in the numerical range are also applicable; a content of the carry is 9-11 mL/L, for example, it may be 9 mL/L, 10 mL/L or 11 mL/L, but the content is not limited to the listed values, and other unlisted values in the numerical range are also applicable.

Preferably, an average particle size of the metal copper is 0.2-0.5 nm, for example, it may be 0.2 nm, 0.24 nm, 0.28 nm, 0.32 nm, 0.36 nm, 0.4 nm, 0.44 nm, 0.48 nm or 0.5 nm; however, the average particle size is not limited to the listed values, and other unlisted values in the numerical range are also applicable.

Preferably, a pH of the copper plating electrolyte is 9.2-10.0, for example, it may be 9.2, 9.3, 9.4, 9.5, 9.6, 9.7, 9.8, 9.9 or 10; however, the pH is not limited to the listed values, and other unlisted values in the numerical range are also applicable.

Preferably, a temperature of the copper plating electrolyte is 64-68° C., for example, it may be 64° C., 65° C., 66° C., 67° C. or 68° C.; however, the temperature is not limited to the listed values, and other unlisted values in the numerical range are also applicable.

The present application controls a temperature of the copper plating electrolyte, so that the plating layer has more stable crystallization compactness, plating speed and roughness; if the temperature deviation is too large, it will have a negative effect on the thickness, plating speed and roughness of the plating layer in the copper plating process.

Preferably, a specific gravity of the copper plating electrolyte is 18.5-22.5 Baume, for example, it may be 18.5 Baume, 19 Baume, 20 Baume, 21 Baume, 22 Baume or 22.5 Baume; however, the specific gravity is not limited to the listed values, and other unlisted values in the numerical range are also applicable.

The specific gravity of the copper plating electrolyte of the present application is a content of a complexing agent in the electrolyte.

Preferably, a first nickel-layer is obtained by the satin-nickel plating process.

Preferably, the first nickel-layer has a thickness of 2-6 μm, for example, it may be 2 μm, 3 μm, 4 μm, 5 μm or 6 μm; however, the thickness is not limited to the listed values, and other unlisted values in the numerical range are also applicable.

Preferably, the first nickel-layer has a glossiness of 200-250 Gu, for example, it may be 200 Gu, 210 Gu, 220 Gu, 230 Gu, 240 Gu or 250 Gu; however, the glossiness is not limited to the listed values, and other unlisted values in the numerical range are also applicable.

Preferably, the satin-nickel plating process has a residence time of 3940-4060 s, for example, it may be 3940 s, 3960 s, 3980 s, 4000 s, 4020 s, 4040 s or 4060 s; however, the residence time is not limited to the listed values, and other unlisted values in the numerical range are also applicable; preferably, 3990-4010 s.

Preferably, the satin-nickel plating process has a current density of 2-3 A/dm$^2$, for example, it may be 2 A/dm$^2$, 2.2 A/dm$^2$, 2.4 A/dm$^2$, 2.6 A/dm$^2$, 2.8 A/dm$^2$ or 3 A/dm$^2$; however, the current density is not limited to the listed values, and other unlisted values in the numerical range are also applicable.

The current density of the satin-nickel plating process in the present application can affect the deposition rate of the plating layer and the crystallization compactness of the plating layer. If the current density is too large, the deposition rate of the plating layer is fast, but the compactness is poor and the crystal is rough; if the current density is too small, the deposition rate of the plating layer is slow, affecting the efficiency, but the crystal is fine, and too small inorganic impurities will be precipitated and cause a blackened appearance.

Preferably, a satin-plating electrolyte used in the satin-nickel plating process includes the following content of raw materials: 280-320 g/L of nickel sulfate, 40-50 g/L of boric acid, 40-50 g/L of nickel chloride, and a remainder is deionized water.

Exemplarily, a content of the nickel sulfate is 280-320 g/L, for example, it may be 280 g/L, 290 g/L, 300 g/L, 310 g/L or 320 g/L, but the content is not limited to the listed values, and other unlisted values in the numerical range are also applicable; a content of the boric acid is 40-50 g/L, for example, it may be 40 g/L, 42 g/L, 44 g/L, 46 g/L, 48 g/L or 50 g/L, but the content is not limited to the listed values, and other unlisted values in the numerical range are also applicable; a content of the nickel chloride is 40-50 g/L, for example, it may be 40 g/L, 42 g/L, 44 g/L, 46 g/L, 48 g/L or 50 g/L, but the content is not limited to the listed values, and other unlisted values in the numerical range are also applicable.

Preferably, the satin-plating electrolyte has a pH of 3.8-4.2, for example, it may be 3.8, 3.9, 4.0, 4.1 or 4.2; however, the pH is not limited to the listed values, and other unlisted values in the numerical range are also applicable.

The pH of the satin-plating electrolyte in the present application is 3.8-4.2. The higher the pH, the faster the exchange speed of the electroplating solution, and the faster the deposition rate of the plating layer, but it is easy to store hydrogen, which will cause the risk of hydrogen embrittlement, the plating layer stress will increase, and bending will be easy to the risk of cracking; if the pH is too low, the deposition of the plating layer will be slow, the allowable range of the current density will be narrowed, and in severe cases, inorganic impurities will be precipitated, resulting in abnormal shedding of the plating layer.

Preferably, a second nickel-layer is obtained by the semi-bright nickel plating process.

Preferably, a thickness ratio of the first nickel-layer to the second nickel-layer is (2-6 μm):(1-2 μm), for example, it may be 2:1, 2:2, 3:2, 5:1, 5:2, 5:2, 6:1 or 6:2; however, the thickness ratio is not limited to the listed values, and other unlisted values in the numerical range are also applicable.

Preferably, the second nickel-layer has a glossiness of 290-310 Gu, for example, it may be 290 Gu, 295 Gu, 300 Gu, 305 Gu or 310 Gu; however, the glossiness is not limited to the listed values, and other unlisted values in the numerical range are also applicable.

Preferably, the semi-bright-nickel plating process has a residence time of 1960-2040 s, for example, it may be 1960 s, 1980 s, 2000 s, 2020 s or 2040 s; however, the residence time is not limited to the listed values, and other unlisted values in the numerical range are also applicable; preferably, 1995-2005 s.

Preferably, the semi-bright-nickel plating process has a current density of 2-3 A/dm$^2$, for example, it may be 2 A/dm$^2$, 2.2 A/dm$^2$, 2.4 A/dm$^2$, 2.6 A/dm$^2$, 2.8 A/dm$^2$ or 3 A/dm$^2$; however, the current density is not limited to the listed values, and other unlisted values in the numerical range are also applicable.

The current density of the semi-bright-nickel plating process in the present application can affect the deposition rate of the plating layer and the crystallization compactness of the plating layer in the semi-bright-nickel plating process. If the current density is too large, the deposition rate of the plating layer is fast, but the compactness is poor and the crystal is rough; if the current density is too small, the deposition rate of the plating layer is slow, affecting the efficiency, but the crystal is fine, and too small inorganic impurities will be precipitated and cause a blackened appearance.

Preferably, a semi-bright nickel electrolyte used in the semi-bright nickel plating process includes the following content of raw materials: 250-270 g/L of nickel sulfate, 40-50 g/L of boric acid, 40-50 g/L of nickel chloride, 1.3-1.7 mL/L of an auxiliary additive, 0.9-1.1 mL/L of a wetting agent, and a remainder is deionized water.

Exemplarily, a content of the nickel sulfate is 250-270 g/L, for example, it may be 250 g/L, 255 g/L, 260 g/L, 265 g/L or 270 g/L, but the content is not limited to the listed values, and other unlisted values in the numerical range are also applicable; a content of the boric acid is 40-50 g/L, for example, it may be 40 g/L, 42 g/L, 44 g/L, 46 g/L, 48 g/L or 50 g/L, but the content is not limited to the listed values, and other unlisted values in the numerical range are also applicable; a content of the nickel chloride is 40-50 g/L, for example, it may be 40 g/L, 42 g/L, 44 g/L, 46 g/L, 48 g/L or 50 g/L, but the content is not limited to the listed values, and other unlisted values in the numerical range are also applicable; a content of the auxiliary additive is 1.3-1.7 mL/L, for example, it may be 1.3 mL/L, 1.4 mL/L, 1.5 mL/L, 1.6 mL/L or 1.7 mL/L, but the content is not limited to the listed values, and other unlisted values in the numerical range are also applicable; a content of the wetting agent is 0.9-1.1 mL/L, for example, it may be 0.9 mL/L, 0.95 mL/L, 1.0 mL/L, 1.05 mL/L or 1.1 mL/L, but the content is not limited to the listed values, and other unlisted values in the numerical range are also applicable.

Preferably, the semi-bright-nickel electrolyte has a pH of 4.2-4.6, for example, it may be 4.2, 4.3, 4.4, 4.5 or 4.6; however, the pH is not limited to the listed values, and other unlisted values in the numerical range are also applicable.

The pH of the semi-bright-nickel electrolyte in the present application is 4.2-4.6. The higher the pH, the faster the exchange speed of the electroplating solution, and the faster the deposition rate of the plating layer, but it is easy to store hydrogen, which will cause the risk of hydrogen embrittlement, the plating layer stress will increase, and bending will be easy to the risk of cracking; if the pH is too low, the deposition of the plating layer will be slow, the allowable range of the current density will be narrowed, and in severe cases, inorganic impurities will be precipitated, resulting in abnormal shedding of the plating layer.

Preferably, the post-treatment includes water-washing and drying.

Preferably, the drying is performed at 75-85° C., for example, it may be 75° ° C., 77° C., 79° C., 81° C., 83° C. or 85° C.; however, the temperature is not limited to the listed values, and other unlisted values in the numerical range are also applicable.

Preferably, the drying is performed for 10-20 min, for example, it may be 10 min, 12 min, 14 min, 16 min, 18 min or 20 min; however, the time is not limited to the listed values, and other unlisted values in the numerical range are also applicable.

The drying temperature of the present application should not be too low, the drying time should not be too long, otherwise it will make the surface of the product appear yellow and discoloration, affecting the appearance of the product.

As a preferred technical solution of the present application, a process method for controlling a glossiness of an electroplated nickel-layer provided in the present application includes the following steps:

(1) subjecting a metal substrate to degreasing treatment and activating treatment to obtain a treated metal substrate;

(2) in a copper-plating electrolyte with a pH of 9.4-9.8 and a temperature of 64-68° C., subjecting the metal substrate to copper plating with a current density of 0.7-1.0 A/dm$^2$ for 1750-1850 s to obtain a plating layer with a thickness of 1-3 μm and a roughness Ra of 0.15;

wherein, the copper plating electrolyte includes the following content of raw materials: 13-17 g/L of metal copper, 1.3-1.7 mL/L of a brightener, 9-11 mL/L of a carry, and a remainder is deionized water;

(3) in a satin-plating electrolyte with a pH of 3.8-4.2, subjecting the product to satin-nickel plating with a current density of 2-3 A/dm$^2$ for 3940-4060 s to obtain a first nickel-layer with a thickness of 2-6 μm and a glossiness of 200-250 Gu;

wherein, the satin-plating electrolyte includes the following content of raw materials: 280-320 g/L of nickel sulfate, 40-50 g/L of boric acid, 40-50 g/L of nickel chloride, and a remainder is deionized water;

(4) in a semi-bright-nickel electrolyte with a pH of 4.2-4.6, subjecting the product to semi-bright-nickel plating with a current density of 2-3 A/dm$^2$ for 1960-2040 s to obtain a second nickel-layer with a glossiness of 290-310 Gu; a thickness ratio of the first nickel-layer to the second nickel-layer is (2-6 μm):(1-2 μm);

wherein, the semi-bright-nickel electrolyte includes the following content of raw materials: 250-270 g/L of nickel sulfate, 40-50 g/L of boric acid, 40-50 g/L of nickel chloride, 1.3-1.7 mL/L of an auxiliary additive, 0.9-1.1 mL/L of a wetting agent, and a remainder is deionized water; and (5) washing the nickel-plated metal substrate with water, and then drying it at 75-85° C. for 10-20 min.

The product prepared by the process method for controlling a glossiness of an electroplated nickel-layer provided in the present application is used for a camera metal part, and the cleaning image can be obtained by coding it, which is more convenient to read information.

The numerical range in the present application includes not only the above listed values, but also includes any unlisted point values between the above numerical ranges. Limited by the length of an article and for conciseness considerations, the present application no longer exhaustively enumerates the specific point values within the ranges.

Compared with the prior art, the beneficial effects of the present application are as follows.

(1) The process method for controlling a glossiness of an electroplated nickel-layer provided in the present application is simple and facilitates industrial production.

(2) The product sheet with a nickel-layer prepared by the process method for controlling a glossiness of an electroplated nickel-layer provided in the present application has the surface glossiness of 290-310 Gu, which fully meets the specification requirements of the product gloss of 280-350 Gu.

DETAILED DESCRIPTION

The present application is described in further detail below in connection with the embodiments. Those skilled in the art should be understood that the specific embodiments described herein are for the object of explaining the present application only, and not for the object of limiting the present application.

Example 1

This example provides a process method for controlling a glossiness of an electroplated nickel-layer, which includes the following steps:

(1) a metal substrate was degreased and activated, and a treated metal substrate was obtained;

(2) in a copper plating electrolyte with a pH of 9.6 and a temperature of 66° C., the metal substrate was plated with copper at a current density of 0.85 A/dm$^2$ for 1800 s, and a plating layer with a thickness of 2 μm and a roughness Ra of 0.15 was obtained;

wherein the copper plating electrolyte included the following content of raw materials: 15 g/L of metal copper, 1.5 mL/L of a brightener, 10 mL/L of a carry, and the remainder was deionized water;

(3) in a satin-plating electrolyte with a pH of 4, the product was plated with satin-nickel at a current density of 2.5 A/dm$^2$ for 4000 s, a first nickel-layer with a thickness of 5 μm and a glossiness of 230 Gu was obtained;

wherein, the satin-nickel plating electrolyte included the following content of raw materials: 300 g/L of nickel sulfate, 45 g/L of boric acid, 45 g/L of nickel chloride, and a remainder was deionized water;

(4) in a semi-bright-nickel electrolyte with a pH of 4.4, the product was plated with semi-bright-nickel at a current density of 2.5 A/dm$^2$ for 2000 s, a second nickel-layer with a glossiness of 300 Gu was obtained; a thickness ratio of the first nickel-layer to the second nickel-layer is 6:4;

wherein, the semi-bright-nickel electrolyte included the following content of raw materials: 260 g/L of nickel sulfate, 45 g/L of boric acid, 45 g/L of nickel chloride, 1.5 mL/L of an auxiliary additive, 1 mL/L of a wetting agent, and a remainder was deionized water; and (5) the nickel-plated metal substrate was washed with water, and then dried at 80° C. for 15 min.

Example 2

This example provides a process method for controlling a glossiness of an electroplated nickel-layer, which includes the following steps:

(1) a metal substrate was degreased and activated, and a treated metal substrate was obtained;

(2) in a copper plating electrolyte with a pH of 9.4 and a temperature of 64° C., the metal substrate was plated with copper at a current density of 0.7 A/dm$^2$ for 1850 s, and a plating layer with a thickness of 3 μm and a roughness Ra of 0.15 was obtained;

wherein the copper plating electrolyte included the following content of raw materials: 17 g/L of metal copper, 1.3 mL/L of a brightener, 9 mL/L of a carry, and the remainder was deionized water;

(3) in a satin-nickel plating electrolyte with a pH of 3.8, the product was plated with satin-nickel at a current density of 3 A/dm$^2$ for 3940 s, a first nickel-layer with a thickness of 3.5 μm and a glossiness of 240 Gu was obtained;

wherein, the satin-plating electrolyte included the following content of raw materials: 280 g/L of nickel sulfate, 50 g/L of boric acid, 50 g/L of nickel chloride, and a remainder was deionized water;

(4) in a semi-bright-nickel electrolyte with a pH of 4.2, the product was plated with semi-bright-nickel at a current density of 3 A/dm$^2$ for 1960 s, a second nickel-layer with a glossiness of 300 Gu was obtained; a thickness ratio of the first nickel-layer to the second nickel-layer is 2:4;

wherein, the semi-bright-nickel electrolyte included the following content of raw materials: 250 g/L of nickel sulfate, 50 g/L of boric acid, 50 g/L of nickel chloride, 1.7 mL/L of an auxiliary additive, 0.9 mL/L of a wetting agent, and a remainder was deionized water; and (5) the nickel-plated metal substrate was washed with water, and then dried at 75° C. for 20 min.

Example 3

This example provides a process method for controlling a glossiness of an electroplated nickel-layer, which includes the following steps:

(1) a metal substrate was degreased and activated, and a treated metal substrate was obtained;

(2) in a copper plating electrolyte with a pH of 9.8 and a temperature of 68° C., the metal substrate was plated with copper at a current density of 1.0 A/dm$^2$ for 1750 s, and a plating layer with a thickness of 1 μm and a roughness Ra of 0.15 was obtained;

wherein the copper plating electrolyte included the following content of raw materials: 13 g/L of metal copper, 1.3 mL/L of a brightener, 9 mL/L of a carry, and the remainder was deionized water;

(3) in a satin-plating electrolyte with a pH of 4.2, the product was plated with satin-nickel at a current density of 2 A/dm$^2$ for 4060 s, a first nickel-layer with a thickness of 6 μm and a glossiness of 210 Gu was obtained;

wherein, the satin-plating electrolyte included the following content of raw materials: 320 g/L of nickel sulfate, 40-50 g/L of boric acid, 40 g/L of nickel chloride, and a remainder was deionized water;

(4) in a semi-bright-nickel electrolyte with a pH of 4.6, the product was plated with semi-bright-nickel at a current density of 2 A/dm$^2$ for 1960 s, a second nickel-layer with a glossiness of 295 Gu was obtained; a thickness ratio of the first nickel-layer to the second nickel-layer is 6:1;

wherein, the semi-bright-nickel electrolyte included the following content of raw materials: 270 g/L of nickel sulfate, 40 g/L of boric acid, 40 g/L of nickel chloride, 1.3 mL/L of an auxiliary additive, 1.1 mL/L of a wetting agent, and a remainder was deionized water; and (5) the nickel-plated metal substrate was washed with water, and then dried at 85° C. for 10 min.

Example 4

This example provides a process method for controlling a glossiness of an electroplated nickel-layer. The difference between the process method in this example and Example 1 is only that in step (2) of this example, a pH of a copper plating electrolyte was changed to 10, and a temperature was changed to 70° C.

Example 5

This example provides a process method for controlling a glossiness of an electroplated nickel-layer. The difference between the process method in this example and Example 1 is only that in step (2) of this example, a pH of a copper plating electrolyte in the copper plating process was changed to 9, and a temperature was changed to 60° C.

Example 6

This example provides a process method for controlling a glossiness of an electroplated nickel-layer. The difference between the process method in this example and Example 1 is only that in step (2) of this example, a current density of the copper plating process was changed to 0.5 A/dm$^2$.

Example 7

This example provides a process method for controlling a glossiness of an electroplated nickel-layer. The difference between the process method in this example and Example 1 is only that in step (2) of this example, a current density of the copper plating process was changed to 1.2 A/dm$^2$.

Example 8

This example provides a process method for controlling a glossiness of an electroplated nickel-layer. The difference between the process method in this example and Example 1 is only that in step (2) of this example, a thickness of a plating layer in the copper plating process was changed to 5 μm, and a roughness Ra was changed to 0.5.

Example 9

This example provides a process method for controlling a glossiness of an electroplated nickel-layer. The difference between the process method in this example and Example 1 is only that in step (3) of this example, a pH of an electrolyte in the satin-nickel plating process was changed to 3.5.

Example 10

This example provides a process method for controlling a glossiness of an electroplated nickel-layer. The difference between the process method in this example and Example 1 is only that in step (3) of this example, a pH of an electrolyte in the satin-nickel plating process was changed to 4.5.

Example 11

This example provides a process method for controlling a glossiness of an electroplated nickel-layer. The difference between the process method in this example and Example 1 is only that in step (3) of this example, a current density of the satin-nickel plating process was changed to 1.5 A/dm$^2$.

Example 12

This example provides a process method for controlling a glossiness of an electroplated nickel-layer. The difference between the process method in this example and Example 1 is only that in step (3) of this example, a current density of the satin-nickel plating process was changed to 3.5 A/dm$^2$.

Example 13

This example provides a process method for controlling a glossiness of an electroplated nickel-layer. The difference between the process method in this example and Example 1 is only that in step (4) of this example, a pH of an electrolyte in the semi-bright-nickel plating process was changed to 4.

Example 14

This example provides a process method for controlling a glossiness of an electroplated nickel-layer. The difference between the process method in this example and Example 1 is only that in step (4) of this example, a pH of an electrolyte in the semi-bright-nickel plating process was changed to 5.

Example 15

This example provides a process method for controlling a glossiness of an electroplated nickel-layer. The difference between the process method in this example and Example 1 is only that in step (4) of this example, a current density of the semi-bright-nickel plating process was changed to 2.5 A/dm$^2$.

Example 16

This example provides a process method for controlling a glossiness of an electroplated nickel-layer. The difference between the process method in this example and Example 1 is only that in step (4) of this example, a current density of the semi-bright-nickel plating process was changed to 3.5 A/dm$^2$.

Comparative Example 1

This comparative example provides a process method for controlling a glossiness of an electroplated nickel-layer. The difference between the process method in this comparative example and Example 1 is only that a ratio thickness of a plating layer of satin-nickel plating to bright-nickel plating was 7:3, and the copper plating process in step (2) was not performed in this comparative example.

Comparative Example 2

This comparative example provides a process method for controlling a glossiness of an electroplated nickel-layer. The difference between the process method in this comparative example and Example 1 is only that a ratio thickness of a plating layer of satin-nickel plating to bright-nickel plating was 2:8, and the satin-nickel plating process in step (3) was not performed in this comparative example.

Comparative Example 3

This comparative example provides a process method for controlling a glossiness of an electroplated nickel-layer. The difference between the process method in this comparative example and Example 1 is only that a ratio thickness of a plating layer of satin-nickel plating to bright-nickel plating was 1:9, and the copper plating process in step (2) and the satin-nickel plating process in step (3) were not performed in this comparative example.

Comparative Example 4

This comparative example provides a process method for controlling a glossiness of an electroplated nickel-layer. The difference between the process method in this comparative example and Example 1 is only that a ratio thickness of a plating layer of satin-nickel plating to bright-nickel plating was 3:7, and the semi-bright-nickel plating process in step (4) was not performed in this comparative example.

The products with nickel-layers prepared by Examples 1-16 and Comparative Examples 1~4 were tested for glossiness, and the results are shown in Table 1.

The method of glossiness detection in the present application was optical geometric measurement, and the instrument used was ZGM1120 gloss meter.

TABLE 1

| | Glossiness/ Gu | Total thickness of nickel-layers/μm |
|---|---|---|
| Example 1 | 300 | 7 |
| Example 2 | 310 | 5 |
| Example 3 | 290 | 8 |
| Example 4 | 295 | 6.5 |
| Example 5 | 285 | 5.5 |
| Example 6 | 290 | 6.5 |
| Example 7 | 300 | 7.0 |
| Example 8 | 340 | 7.0 |
| Example 9 | 285 | 5.5 |
| Example 10 | 320 | 7.3 |
| Example 11 | 330 | 5.3 |
| Example 12 | 320 | 6.1 |
| Example 13 | 315 | 5.2 |
| Example 14 | 345 | 6.4 |
| Example 15 | 324 | 6.2 |
| Example 16 | 335 | 6.6 |
| Comparative Example 1 | 275 | 6.8 |
| Comparative Example 2 | 365 | 6.5 |
| Comparative Example 3 | 385 | 7.2 |
| Comparative Example 4 | 358 | 6.7 |

It can be seen from Table 1 that the pH and current density, which are easy to adjust, have little effect on the overall glossiness of the product, and the proportion of the matte-nickel plating layer to the semi-bright-nickel plating layer is adjusted, and the glossiness of the product will increase with the proportion of semi-bright-nickel. Therefore, the ratio of the plating layer is the key factor, and other additives are added according to the controlled amount.

In summary, the process method for controlling a gloss of an electroplated nickel-layer provided in the present application can effectively control the glossiness of an electroplated nickel-layer by optimizing the process flow of the electroplated nickel-layer and process parameters in the electroplating process, so that the glossiness of the product reaches 290-310 Gu, which fully meets the specification requirements of the product glossiness of 280-350 Gu.

The applicant declares that the present application illustrates the detailed structural characteristics of the present application through the above embodiments, but the present application is not limited to the detailed structural characteristics, which means that the present application is not necessarily rely on the detailed structural characteristics to be implemented. Those skilled in the art should understand that any improvement of the present application, equivalent substitution of the selected components of the present application and the addition of auxiliary components, and selection of specific methods all fall within the scope of protection and disclosure of the present application.

The applicant declares that the present application illustrates the detailed technological processes of the present application through the above embodiments, but the present application is not limited to the detailed technological processes, which means that the present application is not necessarily rely on the detailed technological processes to be implemented. Those skilled in the art should understand that any improvement of the present application, equivalent substitution of each raw material of the product of the present application and the addition of auxiliary components, and selection of specific methods all fall within the scope of protection and disclosure of the present application.

What is claimed is:

1. A process method for controlling a glossiness of an electroplated nickel-layer to 290-310 Gu, comprising:

subjecting a metal substrate to pre-treatment, copper plating process, satin-nickel plating process, semi-bright-nickel plating process, and post-treatment in turn;

wherein an obtained product sheet with the electroplated nickel-layer prepared by the process method has the glossiness of 290-310 Gu;

wherein a temperature of a copper plating electrolyte used in the copper plating process is 64-68° C., a plating layer in the copper plating process has a roughness Ra of 0.1-0.3, the plating layer in the copper plating process comprises copper;

wherein a first nickel-layer is obtained by the satin-nickel plating process; the satin-nickel plating process has a current density of 2-3 A/dm$^2$; a satin-plating electrolyte used in the satin-nickel plating process has a pH of 3.8-4.2; the first nickel-layer is a satin-nickel layer; and wherein a second nickel-layer is obtained by the semi-bright-nickel plating process; the semi-bright-nickel plating process has a current density of 2-3 A/dm$^2$; a semi-bright-nickel electrolyte used in the semi-bright-nickel plating process has a pH of 4.2-4.6; the second nickel-layer is a semi-bright-nickel layer.

2. The process method according to claim 1, wherein the pre-treatment comprises performing degreasing treatment and activating treatment in sequence.

3. The process method according to claim 1, wherein the plating layer in the copper plating process has a thickness of 1-3 μm.

4. The process method according to claim 1, wherein the copper plating process has a residence time of 1750-1850 s; and the copper plating process has a current density of 0.7-1.0 A/dm$^2$.

5. The process method according to claim 1, wherein the copper plating electrolyte used in the copper plating process comprises metal copper, an average particle size of the metal copper is 0.2-0.5 nm;

a pH of the copper plating electrolyte is 9.2-10.0; and a specific gravity of the copper plating electrolyte is 18.5-22.5 Baume.

6. The process method according to claim 1, wherein the first nickel-layer has a thickness of 2-6 μm; and the first nickel-layer has a glossiness of 200-250 Gu.

7. The process method according to claim 1, wherein the satin-nickel plating process has a residence time of 3940-4060 s.

8. The process method according to claim 1, wherein the satin-plating electrolyte used in the satin-nickel plating process comprises the following content of raw materials: 280-320 g/L of nickel sulfate, 40-50 g/L of boric acid, 40-50 g/L of nickel chloride, and a remainder is deionized water.

9. The process method according to claim 1, wherein a thickness ratio of the first nickel-layer to the second nickel-layer is (2-6 μm):(1-2 μm); and the second nickel-layer has a glossiness of 290-310 Gu.

10. The process method according to claim 1, wherein the semi-bright-nickel plating process has a residence time of 1960-2040 s.

11. The process method according to claim 1, wherein the semi-bright-nickel electrolyte used in the semi-bright-nickel plating process comprises the following content of raw materials: 250-270 g/L of nickel sulfate, 40-50 g/L of boric acid, 40-50 g/L of nickel chloride, 1.3-1.7 mL/L of an auxiliary additive, 0.9-1.1 mL/L of a wetting agent, and a remainder is deionized water.

12. The process method according to claim 1, wherein the post-treatment comprises water-washing and drying;

the drying is performed at 75-85° C.; and the drying is performed for 10-20 min.

* * * * *